US011713698B2

(12) United States Patent
Stretch et al.

(10) Patent No.: US 11,713,698 B2
(45) Date of Patent: Aug. 1, 2023

(54) SWITCH PROVIDING ON-BOARD DIAGNOSTIC FEEDBACK FOR ELECTROMAGNETICALLY ACTUATED LATCHING ROCKER ARM ASSEMBLY

(71) Applicant: Eaton Intelligent Power Limited, Dublin (IE)

(72) Inventors: Dale Arden Stretch, Novi, MI (US); Michael J. Campbell, Scotts, MI (US)

(73) Assignee: Eaton Intelligent Power Limited, Dublin (IE)

( * ) Notice: Subject to any disclaimer, the term of this patent is extended or adjusted under 35 U.S.C. 154(b) by 0 days.

(21) Appl. No.: 17/050,438

(22) PCT Filed: Apr. 24, 2019

(86) PCT No.: PCT/EP2019/025121
§ 371 (c)(1),
(2) Date: Oct. 24, 2020

(87) PCT Pub. No.: WO2019/206461
PCT Pub. Date: Oct. 31, 2019

(65) Prior Publication Data

US 2021/0062685 A1 Mar. 4, 2021

Related U.S. Application Data

(60) Provisional application No. 62/663,119, filed on Apr. 26, 2018.

(51) Int. Cl.
*F01L 1/18* (2006.01)
*F01L 13/00* (2006.01)
*F01L 9/21* (2021.01)

(52) U.S. Cl.
CPC ..... *F01L 1/185* (2013.01); *F01L 13/0005* (2013.01); *F01L 13/0036* (2013.01);
(Continued)

(58) Field of Classification Search
CPC ... F01L 1/185; F01L 1/047; F01L 9/20; F01L 13/0005; F01L 13/0036; F01L 2009/2103;
(Continued)

(56) References Cited

U.S. PATENT DOCUMENTS 2,468,498 A * 4/1949 Kyle, Jr. ..... H01H 75/04 361/73
3,489,917 A 1/1970 Macit, I
(Continued)

FOREIGN PATENT DOCUMENTS

CN 106661974 A 5/2017
CN 106715847 A 5/2017
(Continued)

OTHER PUBLICATIONS

International Search Report and Written Opinion for PCT/EP2019/025121; dated Jul. 18, 2019; pp. 1-9.

*Primary Examiner* — Devon C Kramer
*Assistant Examiner* — Wesley G Harris
(74) *Attorney, Agent, or Firm* — Baker Botts L.L.P.

(57) ABSTRACT

A rocker arm assembly that includes an electromagnetic latch assembly with a latch pin and an actuator operative to actuate the latch pin between a first position and a second position. The actuator includes an electromagnet powered through a coil circuit. The rocker arm assembly further includes a switch in a switch circuit. The coil circuit and the switch circuit are connected in parallel. Moving the latch pin between the first position and the second position opens and closes the switch. In an alternate embodiment, relative motion of two rocker arms opens and closes the switch. The rocker arm assembly allows OBD information to be obtained without making electrical connections to the rocker arm assembly other than ones provided to power the electromagnet.

20 Claims, 10 Drawing Sheets

(52) U.S. Cl.
CPC . *F01L 2001/186* (2013.01); *F01L 2009/2103* (2021.01); *F01L 2800/11* (2013.01); *F01L 2820/031* (2013.01)

(58) Field of Classification Search
CPC ..... F01L 9/26; F01L 9/40; F01L 2001/186; F01L 2800/11; F01L 2820/031; F01L 2103/101; F01L 2201/00; F01L 2013/001; H01H 50/0026; H01H 50/64
See application file for complete search history.

(56) References Cited

U.S. PATENT DOCUMENTS

| | | | | |
|---|---|---|---|---|
| 2008/0006232 | A1* | 1/2008 | Gregor ..... | F01L 13/0036 123/90.15 |
| 2017/0236630 | A1 | 8/2017 | Kank et al. | |

FOREIGN PATENT DOCUMENTS

| | | | |
|---|---|---|---|
| DE | 19712062 | A1 | 10/1998 |
| GB | 1410008 | A1 | 10/1975 |
| WO | 2017156125 | A2 | 9/2017 |

* cited by examiner

SWITCH PROVIDING ON-BOARD DIAGNOSTIC FEEDBACK FOR ELECTROMAGNETICALLY ACTUATED LATCHING ROCKER ARM ASSEMBLY

FIELD

The present teachings relate to valvetrains, particularly valvetrains providing variable valve lift (WL) or cylinder deactivation (CDA).

BACKGROUND

Some rocker arm assemblies, such as switching roller finger followers (SRFFs), use latches to implement variable valve lift (VVL) or cylinder deactivation (CDA). There has been a long felt need to provide diagnostic systems that report whether these latches are operating as intended. But a practical system for providing that data has proven elusive.

SUMMARY

One of the inventors' concepts relates to a rocker arm assembly that includes an electromagnetic latch assembly. The electromagnetic latch assembly includes a latch pin and an actuator operative to actuate the latch pin between a first position and a second position. The rocker arm assembly includes a first rocker arm and a second rocker arm that are selectively engaged by the latch pin. The rocker arm assembly is in one of two modes dependent on whether the latch pin is in the position that engages the two rocker arms. In one mode, the rocker arm assembly is operative to actuate a moveable valve to produce a first valve lift profile. In the other mode, the rocker arm assembly is operative to actuate the moveable valve to produce a second valve lift profile, which is distinct from the first valve lift profile. The second lift profile may be a zero lift profile, in which case the valve is deactivated. Accordingly, the rocker arm assembly may be a two-step rocker arm that implements WL or may be a CDA rocker arm.

The actuator of the electromagnetic latch assembly includes an electromagnet powered through a coil circuit. The rocker arm assembly further includes a switch. The switch is open or closed depending on a configuration of the rocker arm assembly. The configuration depends on one or both the latch pin position and the relative positions of the first rocker arm and the second rocker arm. In accordance with one aspect of the present teachings, the coil circuit and the switch circuit are connected in parallel. Making reliable electrical connections to a rocker arm assembly can be challenging. The present teachings allow OBD information to be obtained from the rocker arm assembly without making electrical connections to the rocker arm assembly other than those provided to power an actuator.

Some aspects of the presents teachings relate to a method of operating the rocker arm assembly to obtain OBD information. In some of these teachings, a circuit that includes the coil circuit is pulsed. A response to the pulse is analyzed to determine whether a portion of the pulse current passed through the switch circuit. Several pulses may be used to obtain the desired information.

In some of these teachings, the electromagnetic latch assembly is structured to stabilize the latch pin's position independently from the electromagnet both when the latch pin is in the first position and when the latch pin is in the second position. In some of these teachings, the electromagnet energized with a current in a first direction is operable to actuate the latch pin from the first position to the second position; and the electromagnet energized with a current in a second direction, which is a reverse of the first direction, is operable to actuate the latch pin from the second position to the first position. This bi-stable structure relates to a reduced coil size but creates additional challenges to using the actuator power circuit for OBD. In some of these teachings, the coil circuit is grounded through the structure of the rocker arm assembly. That design further reduces the number of wiring connection that must be made to the rocker arm assembly.

In some of these teachings, the actuator is operative to actuate the latch pin from a first position to a second position while the switch is closed. In some aspects of the present teaching this functionality is facilitated by making the switch circuit have higher resistance than the coil circuit. In some of these teachings, most of the switch circuit resistance is provide by one or more coatings on contact surfaces in the switch circuit. A coating can be a simple structure that provides the desired resistance.

In some of these teachings, the switch is opened and closed by movement of the latch pin. In some of these teachings, the switch has two leads and in one of the first or second positions, the latch pin contacts both the leads to close the switch. The terminals may be located to one side of the electromagnet, which may be a side out of which the latch pin extends.

The actuator may include a core support configured to translate along an axis through the electromagnet. The core support may have first and second ends, opposite one-another along the axis. The latch pin may be mounted on the first end of the core support. In some of these teachings the switch is closed by the second end of the core support when the latch pin is fully retracted. This switch location allows for a compact design.

The rocker arm assembly may include a first rocker arm and a second rocker that are selectively engaged by the latch pin. In some of these teachings, the switch is closed by relative motion between the rocker arms, wherein when the rocker arms are engaged by the latch pin, the rocker arms are prevented from undergoing or enabled to undergo the relative motion that opens or closes the switch. This structure can be used to directly determine whether the rocker arms are engaged.

In some of these teachings, the electromagnet is mounted to a rocker arm of the rocker arm assembly. The electromagnet may include a coil. The coil may be wound about a bobbin that provides tie-offs for the coil. Terminal pins may be installed at those coil tie-offs. In some of these teachings, terminals at the coil tie-offs provide terminals for the switch circuit. This simplifies the overall design.

In some of these teachings, a frame providing electrical contacts for transferring power to the rocker arm assembly is mounted on a rocker arm of the rocker arm assembly. In some of these teachings, wiring for the switch circuit is mounted to the contact frame. In some of these teachings, the contact frame is over-molded around the wiring for the switch circuit. This allows the switch circuit wiring to be conveniently installed and protected.

In some of these teachings, components of the electromagnet latch assembly are installed within a chamber inside one of the rocker arms. In some of these teachings, wiring for the switch circuit is also installed inside the rocker arm. The wires may emerge from the rocker arm adjacent where the latch pin extends out of the rocker arm. The wiring for the switch may be installed in the rocker arm together the component of the electromagnetic latch assembly. Installing the switch wiring within the rocker arm protects the switch wiring.

In some of these teaching, the switch is close by conduction through a structural component of the rocker arm assembly. In some of these teachings, that structural component is one of the rocker arms. In some of these teachings, that structural component is the latch pin.

The primary purpose of this summary has been to present certain of the inventors' concepts in a simplified form to facilitate understanding of the more detailed description that follows. This summary is not a comprehensive description of every one of the inventors' concepts or every combination of the inventors' concepts that can be considered "invention". Other concepts of the inventors will be conveyed to one of ordinary skill in the art by the following detailed description together with the drawings. The specifics disclosed herein may be generalized, narrowed, and combined in various ways with the ultimate statement of what the inventors claim as their invention being reserved for the claims that follow.

DETAILED DESCRIPTION

Figure 1D:
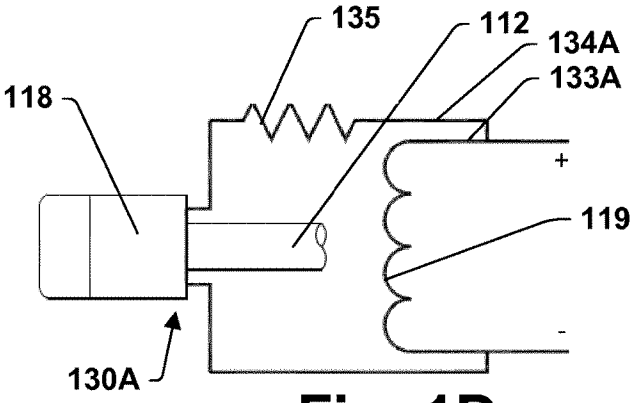
FIG. 1D is a circuit diagram for the latch assembly of FIG. 1A.
Figure 1C:
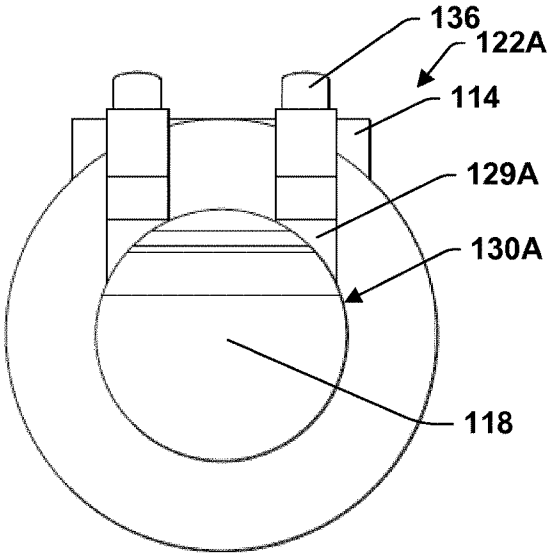
FIG. 1C is a rear view of the electromagnetic latch assembly of FIG. 1A.
Figure 1A:
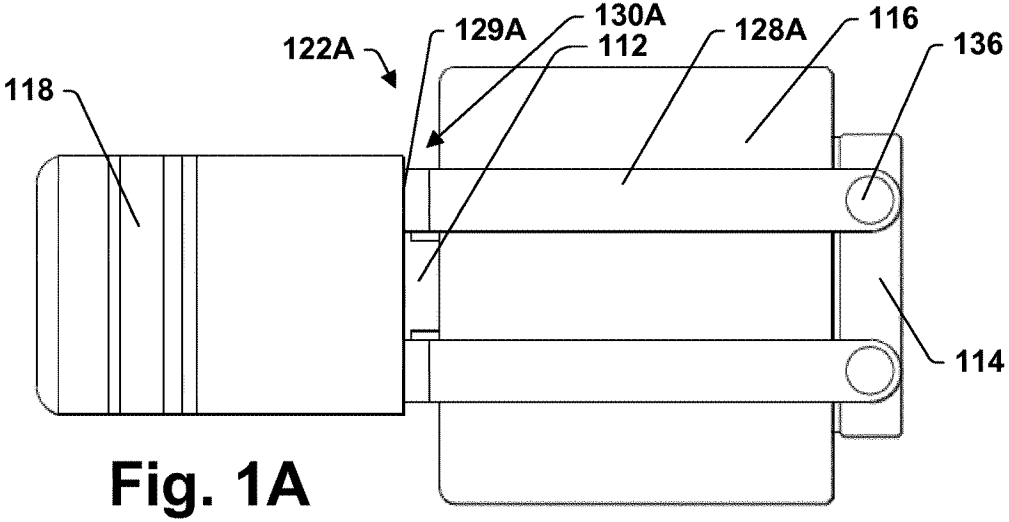
FIG. 1A is a top view of an electromagnetic latch assembly according to some aspects of the present teachings in an unlatched state.
Figure 1B:
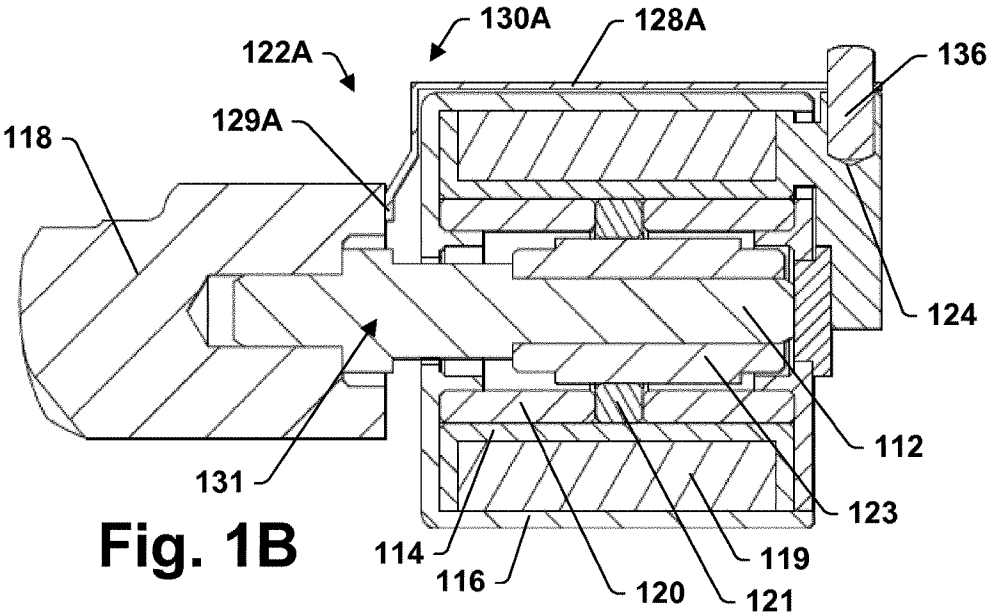
FIG. 1B is a cross-sectional side view of the electromagnetic latch assembly of FIG. 1A.

FIGS. 1A-1C illustrate an electromagnetic latch assembly 122A according to some aspects of the present teachings. Electromagnetic latch assembly 122A, includes a latch pin assembly 131, an electromagnet 119, and two permanent magnets 120. Latch pin assembly 131 includes a paramagnetic core 112 on which are mounted an electrically conductive latch pin 118 and a ferromagnetic ferule 123. Electromagnet 119 is a coil of wire wound about bobbin 114 and contained within a low coercivity ferromagnetic shell 116. Permanent magnets 120 are arranged with confronting polarities and are separated by a low coercivity ferromagnetic ring 121.

Figure 2D:
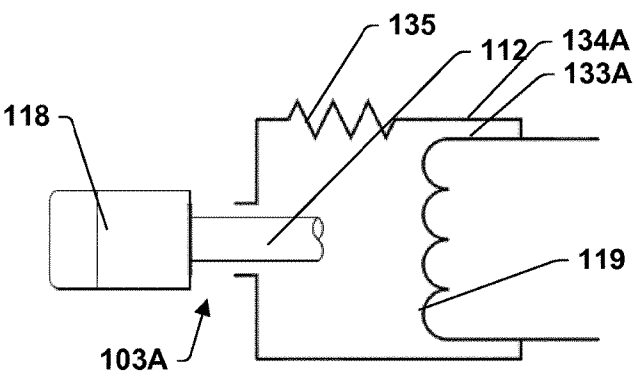
FIG. 2D is the view of FIG. 1D, but with the electromagnetic latch assembly in a latched state.
Figure 2C:
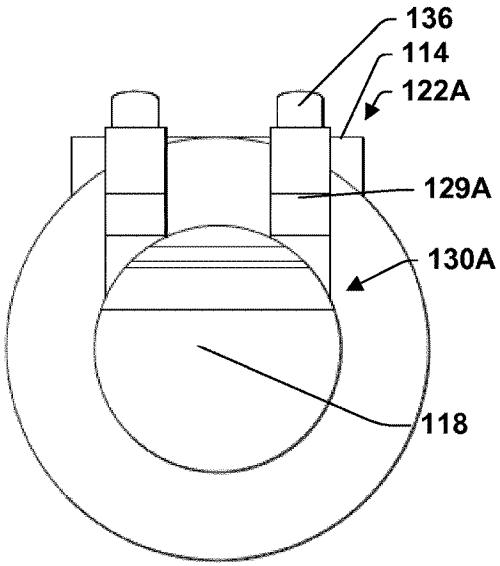
FIG. 2C is the view of FIG. 1C, but with the electromagnetic latch assembly in a latched state.
Figure 2A:
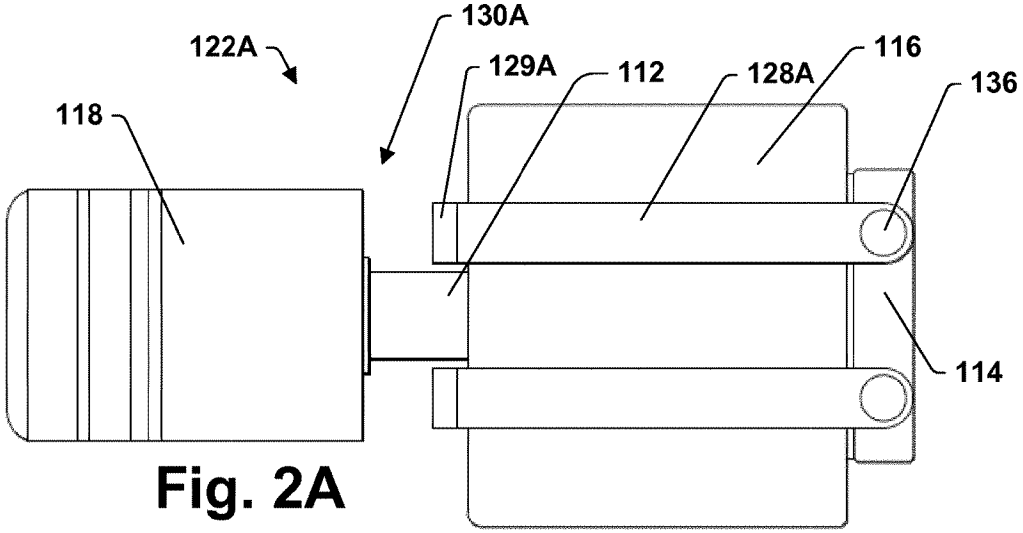
FIG. 2A is the view of FIG. 1A, but with the electromagnetic latch assembly in a latched state.
Figure 2B:
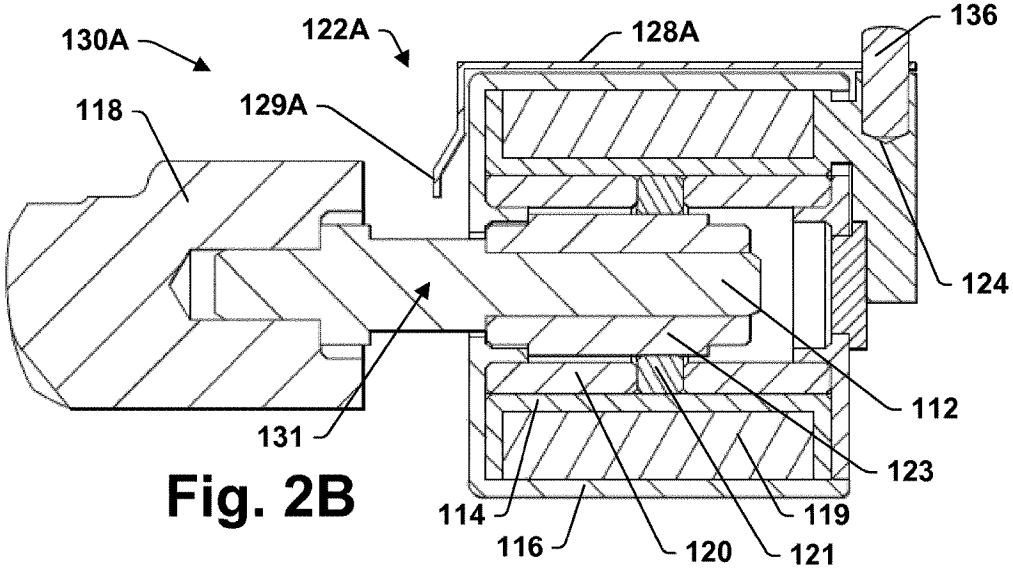
FIG. 2B is the view of FIG. 1B, but with the electromagnetic latch assembly in a latched state.

FIGS. 1A-C show electromagnetic latch assembly 122A with latch pin assembly 131 in a first position, which may be described as an unlatched state. FIGS. 2A-2C show electromagnetic latch assembly 122A with latch pin assembly 131 in a second position, which may be described as an unlatched state. Permanent magnets 120 operate on latch pin assembly 131 through ferule 123 and magnetic circuits that are completed by ring 121 and shell 116. The magnetic circuits taken by flux from permanent magnets 120 shift as latch pin assembly 131 moves between the first and second positions.

Electromagnet 119 is operable to alter magnetic polarizations in the magnetic circuits taken by flux from permanent magnets 120. Energized with current in a first direction, electromagnet 119 is operable to cause latch pin assembly 131 to translate from the first position to the second position. Once latch pin assembly 131 is in the second position, permanent magnets 120 will stably maintain latch pin assembly 131 in the second position after power to electromagnet 119 is cut off. Energized with current in a second direction, which is the reverse of the first, electromagnet 119 is operable to cause latch pin assembly 131 to translate from the second position back to the first position. Once latch pin assembly 131 is in the first position, permanent magnets 120 will stably maintain latch pin assembly 131 in the first position after power to electromagnet 119 is again cut off.

Electromagnetic latch assembly 122A includes a switch 130A in a switch circuit 134A. Bobbin 114 has coil tie-offs 124. Coil tie-off pins 136 are installed in coil tie-offs 124 and provide terminals for a coil circuit 133A that includes electromagnet 119. Coil tie-off pins 136 also provide terminals for switch circuit 134A, which is connected in parallel with coil circuit 133A as shown in FIG. 1D. Leads 128A of switch circuit 134A run from switch contacts 129A to coil tie-off pins 136. Leads 128A and switch contacts 129A may be formed from metal ribbons. In the unlatched state, latch pin 118 contacts both contacts 129A, closing switch 122A and switch circuit 134A. Actuating latch pin assembly 131 to the unlatched state moves latch pin 118 away from contacts 129A, opens switch 122A, and open switch circuit 134A.

Figure 3:
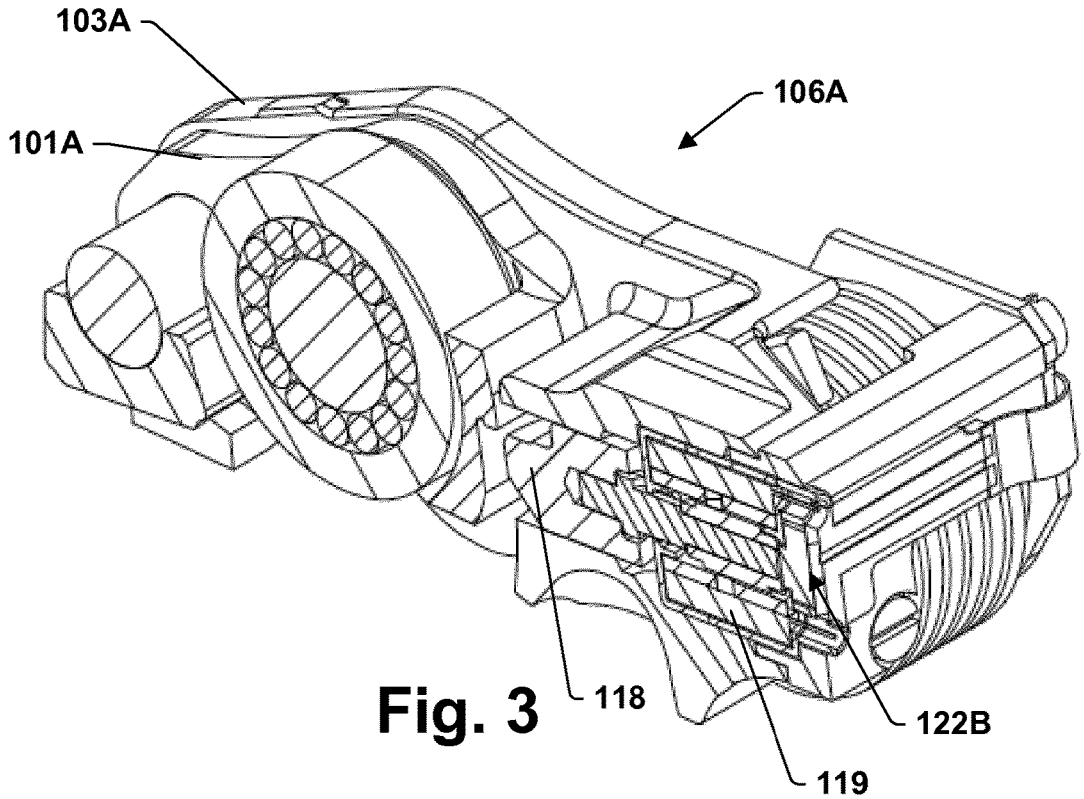
FIG. 3 is a cross-sectional perspective view of a rocker arm assembly that can be fit with an electromagnetic latch assembly according to the present teachings to provide a rocker arm assembly according to the present teachings.
Figure 4:
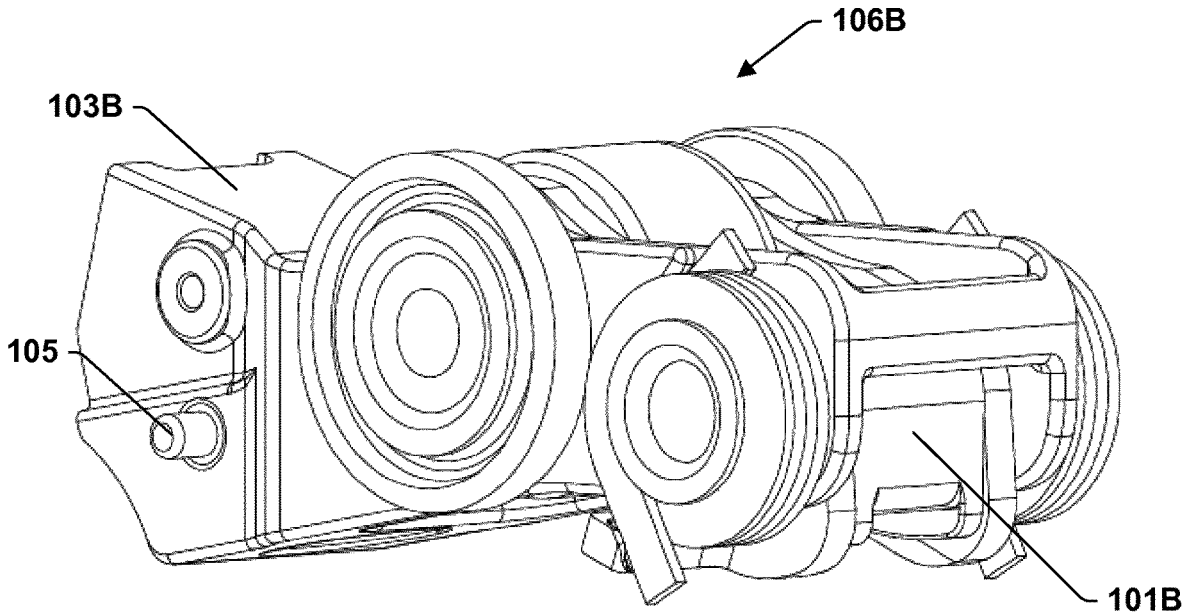
FIG. 4 is a perspective view of another rocker arm assembly that can be fit with an electromagnetic latch assembly according to the present teachings to provide a rocker arm assembly according to the present teachings.

FIGS. 3 and 4 illustrate rocker arm assemblies 106A and 106B that include inner arms 101 and outer arms 103. Electromagnetic latch assembly 122A may be installed in the outer arm 103 of either of these rocker arm assemblies 106. Rocker arm assembly 106A is illustrated with an electromagnetic latch assembly 122B which, like electromagnetic latch assembly 122A, includes a coil 119 and a latch pin 118. Mounting electromagnetic latch assembly 122B to outer arm 103A mounts coil 119 to outer arm 103A.

Figure 5:
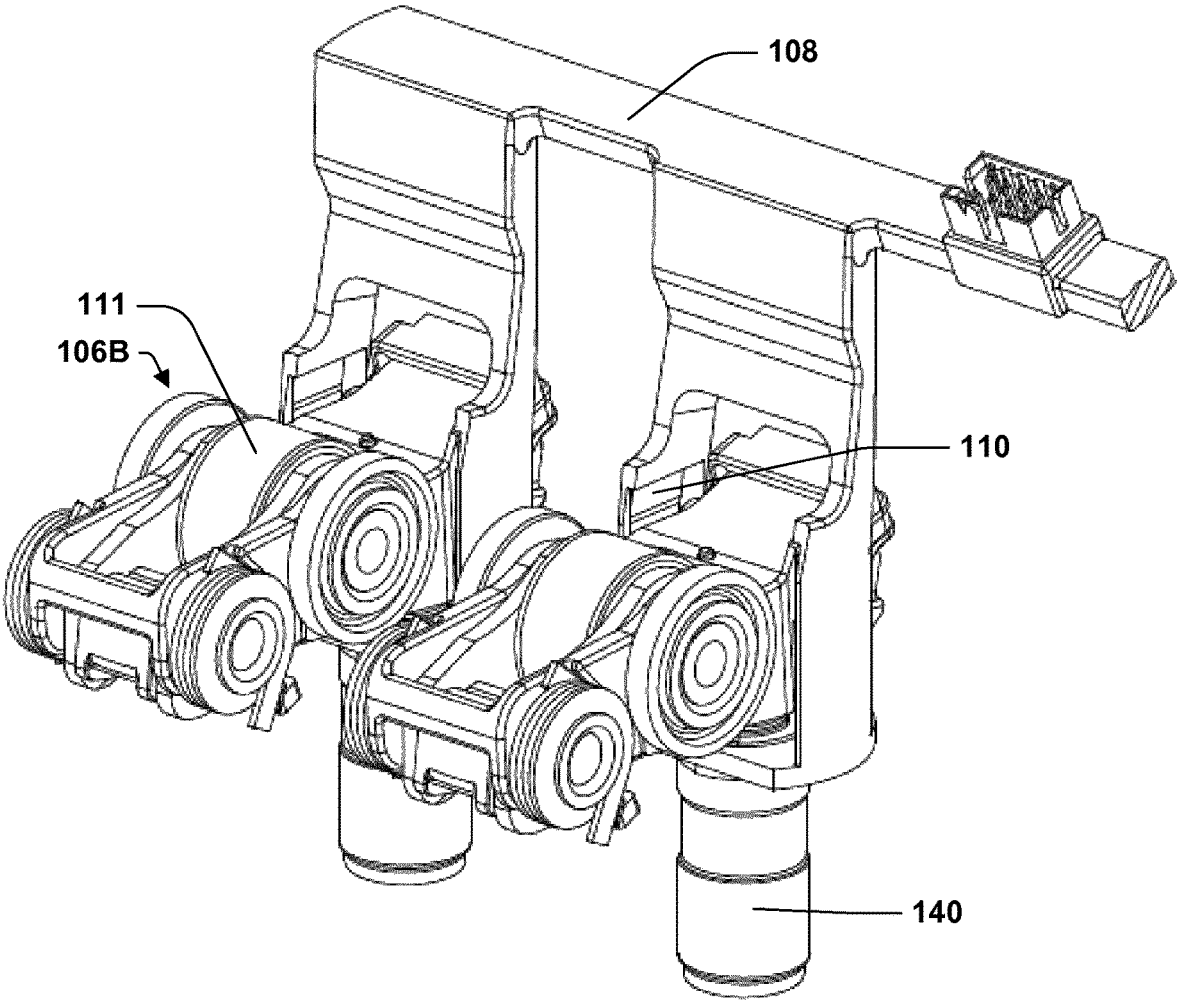
FIG. 5 illustrates a structure for providing power to the rocker arm assemblies of FIG. 4.

Operating electromagnetic latch assemblies 122 on rocker arm assemblies 106 requires power transfer to rocker assemblies 106. A sliding contact pin 105 is mounted to one side of rocker arm assembly 106B for receiving this power. There may be one contact pin 105 on each side of rocker arm assembly 106B to provide two poles. Alternatively, the electromagnetic latch assembly 122 may be grounded through the structure of rocker arm assembly 106B. As shown in FIG. 5, a framework 108 may locate against pivots 140 and hold contact pads 110 in abutment with contact pins 105. Contact pins 105 slide across the surfaces of contact pads 110. Contact may be maintained even as rocker arm assembly 106B is actuated and as rocker arm assembly 106B is raised and lowered by pivot 140 to adjust lash.

Figure 6:
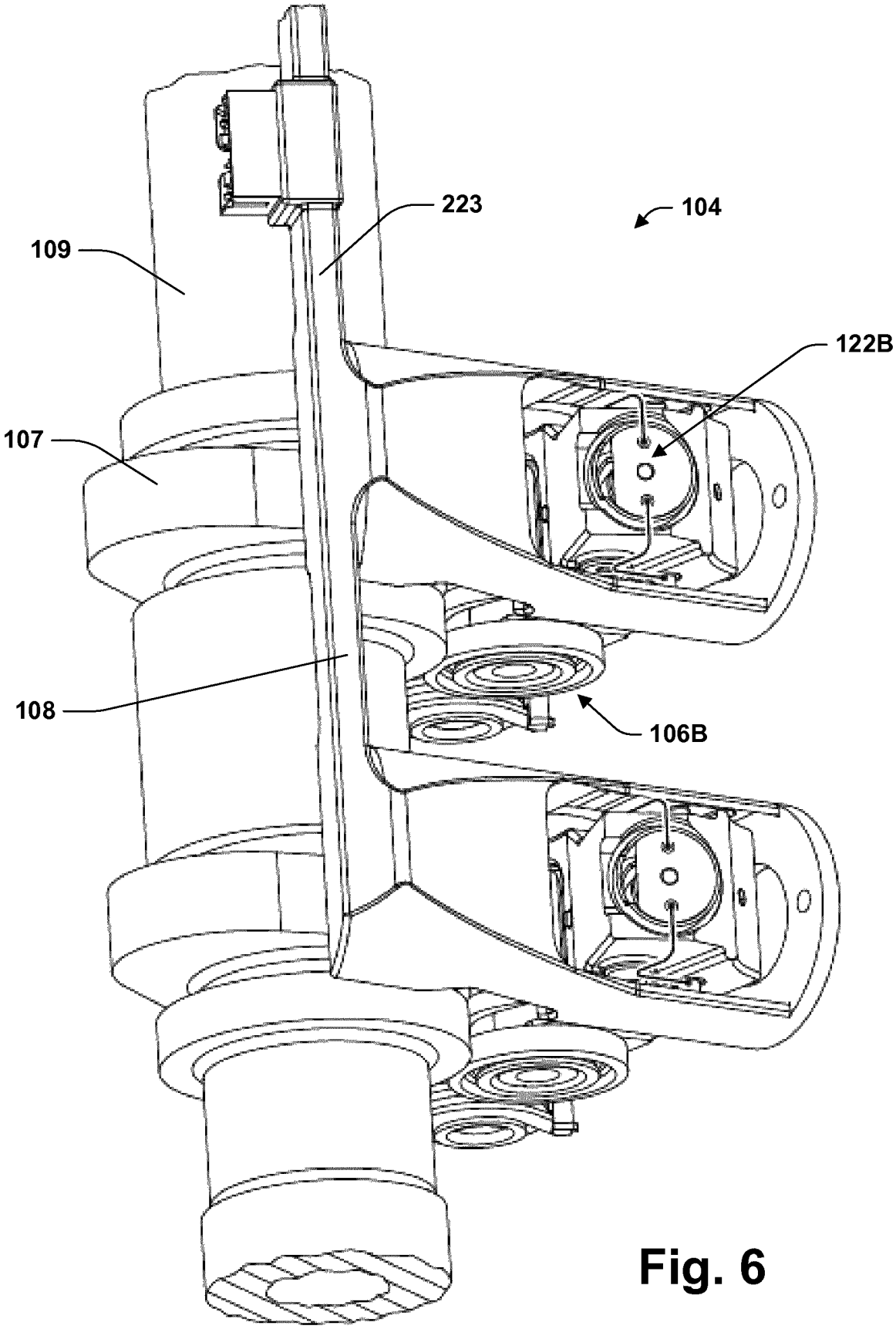
FIG. 6 illustrates a portion of a valvetrain that includes the rocker arm assemblies of FIG. 4.
Figure 7:
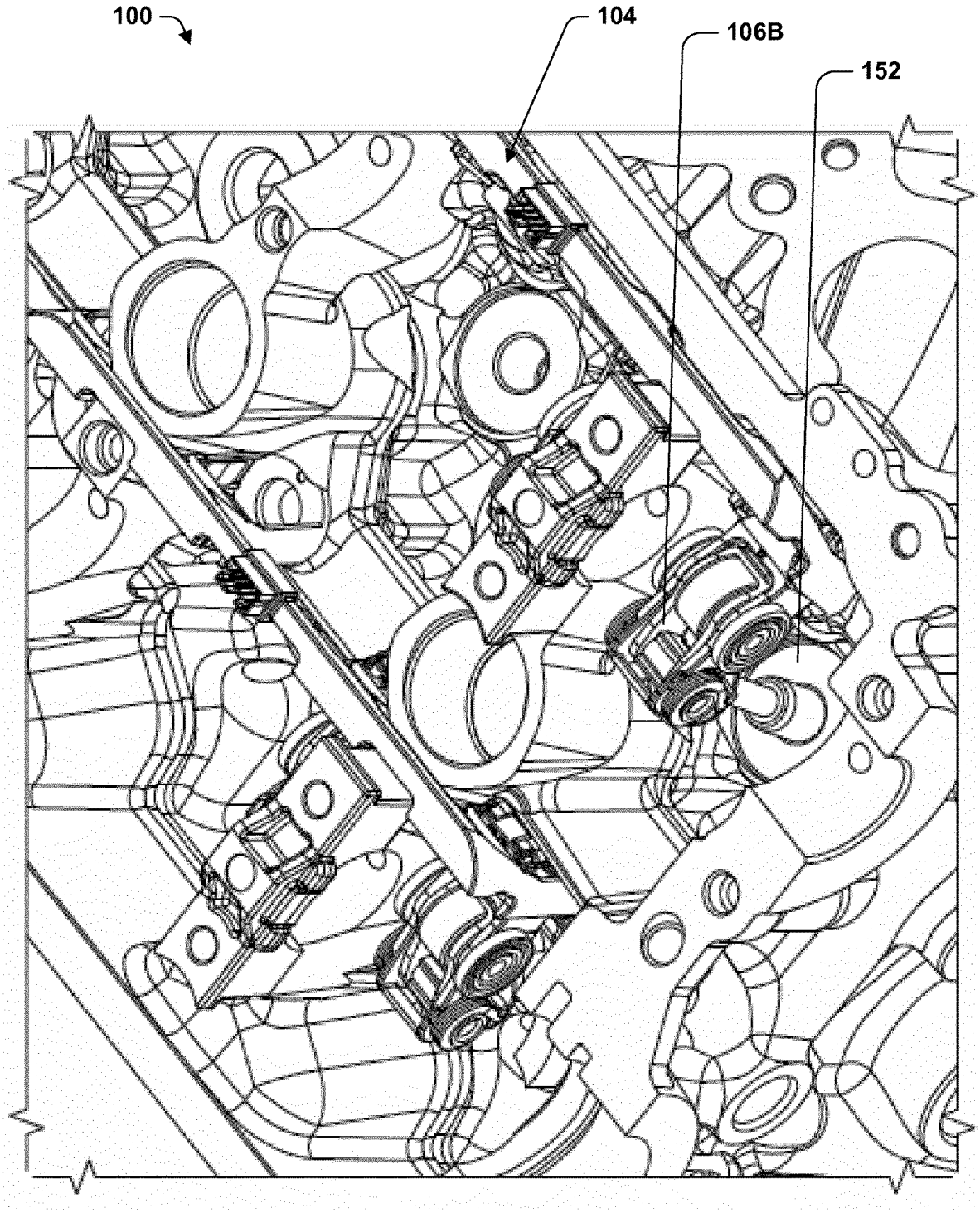
FIG. 7 illustrates a portion of an internal combustion engine that includes the valvetrain of FIG. 6.

Rocker arm assemblies 106 include cam followers 111 on inner arms 103, which are pivotally connected to outer arms 103. As shown in FIG. 6, a valvetrain 104 includes a camshaft 109 with cams 107 configured to engage and actuate rocker arm assemblies 106 through cam followers 111 as camshaft 109 rotate. If latch pin 118 is in the latched state, this actuation will cause inner arms 101 and outer arms 103 to pivot together on pivots 140. As can be seen from FIG. 7, when valvetrain 104 is installed in an internal combustion engine 100, this motion will cause valve 152 to open and close in relation to the cam cycle. On the other hand, if latch pin 118 is in the unlatched condition, this motion will cause inner arm 101B to pivot while outer arm 103B remains stationary and valve 152 remains closed.

Figure 8A:
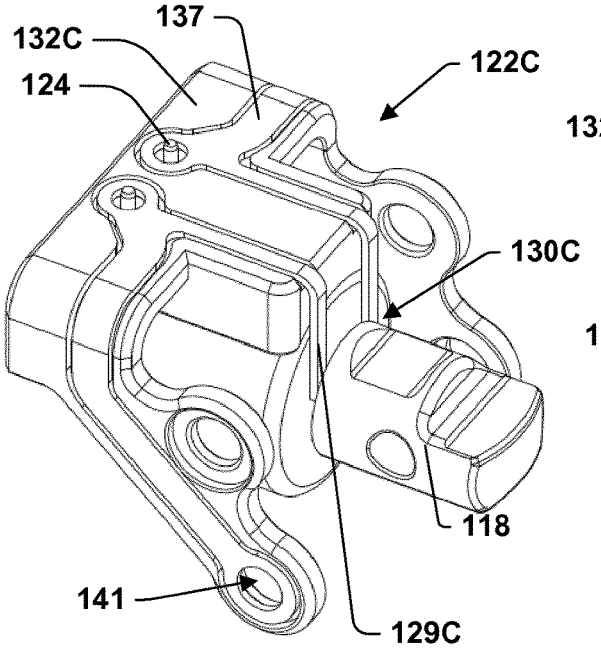
FIG. 8A is a perspective view of an electromagnetic latch assembly according to some aspects of the present teachings.
Figure 8B:
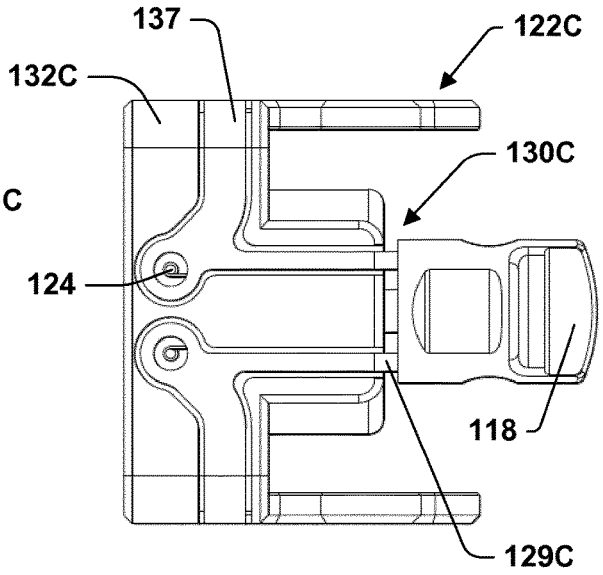
FIG. 8B is a top view of the electromagnetic latch assembly of FIG. 8A.
Figure 8C:
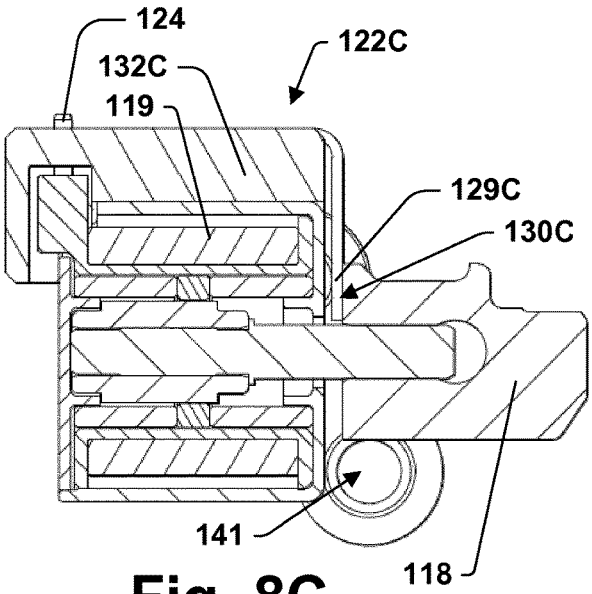
FIG. 8C is a cut-away side view of the electromagnetic latch assembly of FIG. 8A.
Figure 8D:
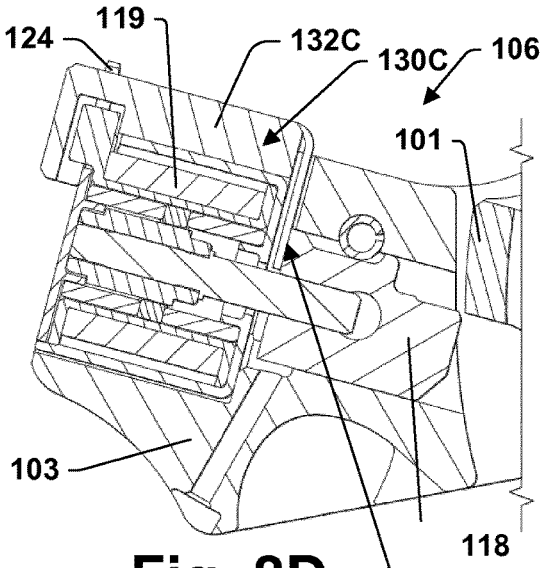
FIG. 8D is a cut-away side view of a rocker arm assembly according to the present teachings that includes the electromagnetic latch assembly of FIG. 8A.

FIG. 8A-8C illustrates an electromagnetic latch assembly 122C. FIG. 8D illustrates electromagnetic latch assembly 122C installed on the outer arm 103 of a rocker arm assembly 106. Electromagnetic latch assembly 122C is similar to electromagnetic latch assembly 122A and includes a switch 130C closed by latch pin 118. Electromagnetic latch assembly 122C includes a contact frame support 132C that fits in and around an outer rocker arm 103. Contact frame support 132C holds metal ribbons 137 that provide leads for switch 130C and leads for coupling contact pins 105 (see. FIG. 5) through which power may be provided to electromagnet 119. Contact pins 105 fit through openings 141 in contact frame support 132C. Contact frame support 132C may be over-molded around metal ribbons 137.

Figure 9A:
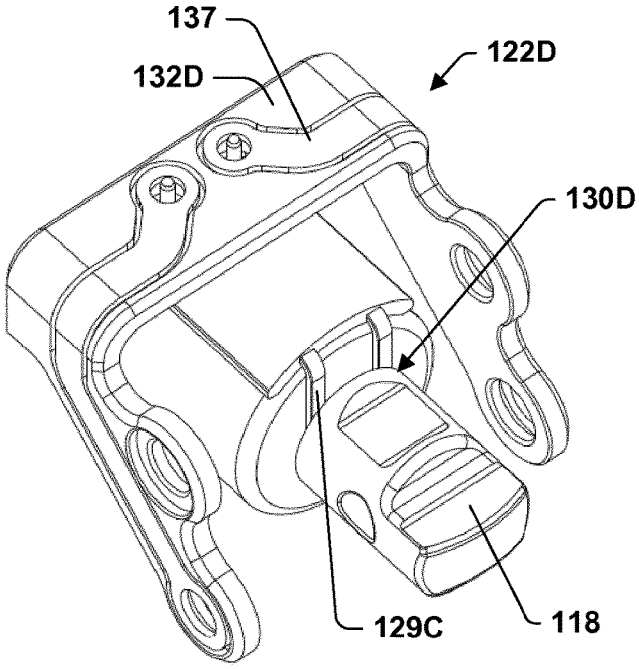
FIG. 9A is a perspective view of an electromagnetic latch assembly according to some aspects of the present teachings.
Figure 9B:
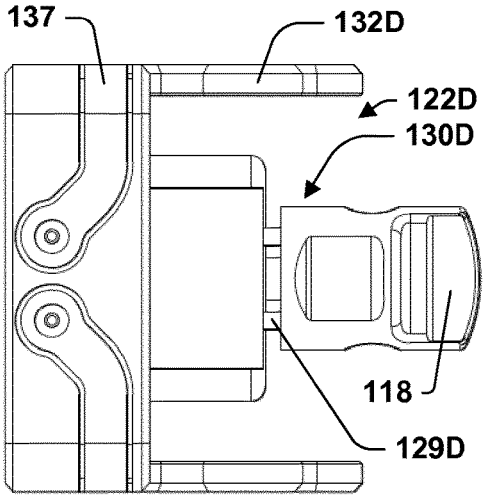
FIG. 9B is a top view of the electromagnetic latch assembly of FIG. 9A.
Figure 9C:
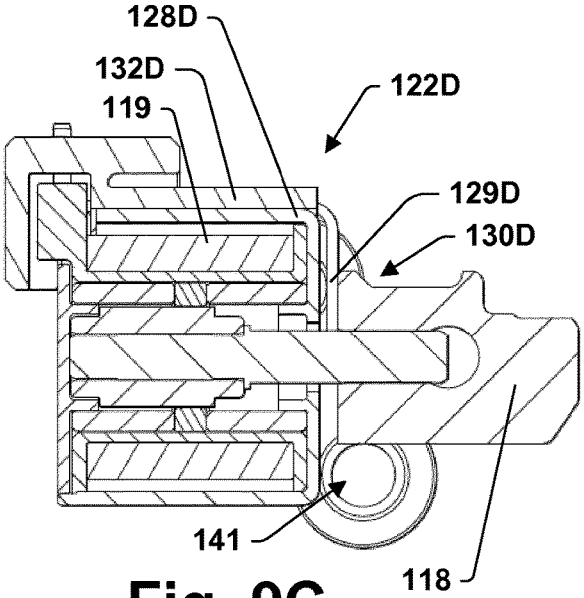
FIG. 9C is a cut-away side view of the electromagnetic latch assembly of FIG. 9A.
Figure 9D:
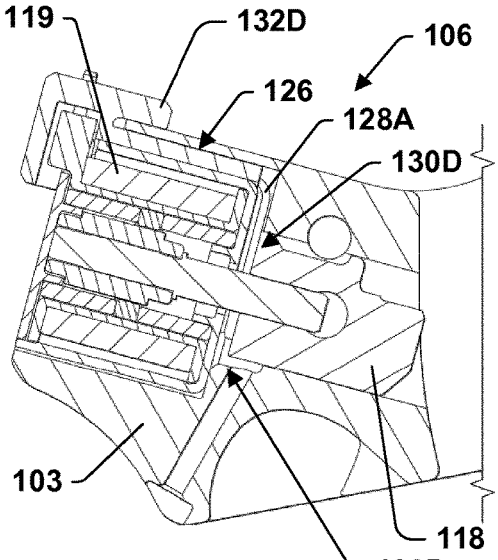
FIG. 9D is a cut-away side view of a rocker arm assembly according to the present teachings that includes the electromagnetic latch assembly of FIG. 9A.
Figure 10A:
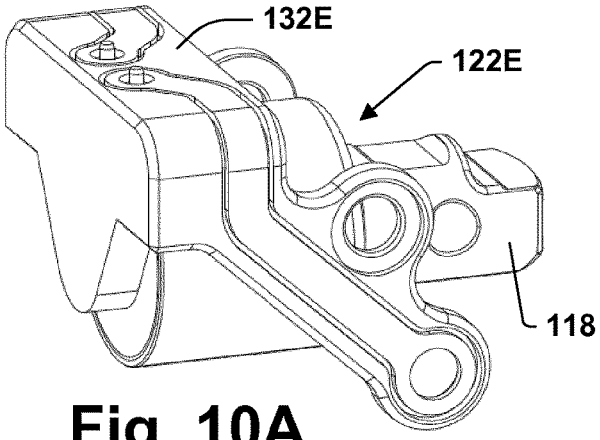
FIG. 10A is a perspective view of an electromagnetic latch assembly according to some aspects of the present teachings.
Figure 10B:
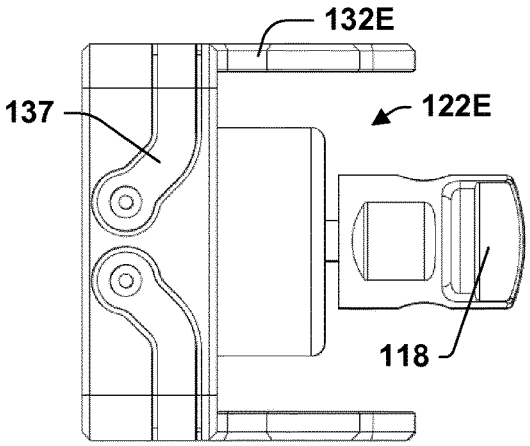
FIG. 10B is a top view of the electromagnetic latch assembly of FIG. 10A.
Figure 10C:
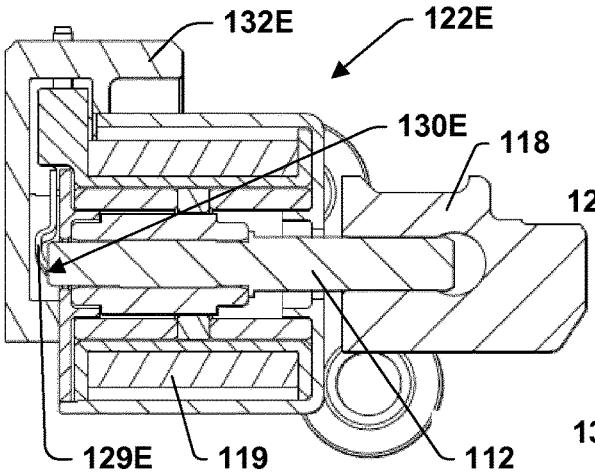
FIG. 10C is a cut-away side view of the electromagnetic latch assembly of FIG. 10A.
Figure 10D:
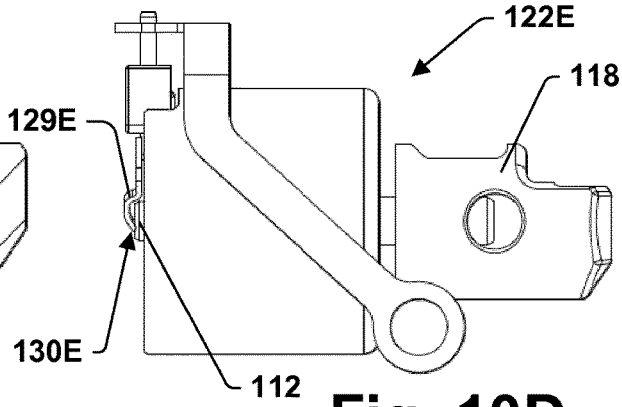
FIG. 10D is a side view of the electromagnetic latch assembly of FIG. 10A with the contact frame removed.
Figure 10E:
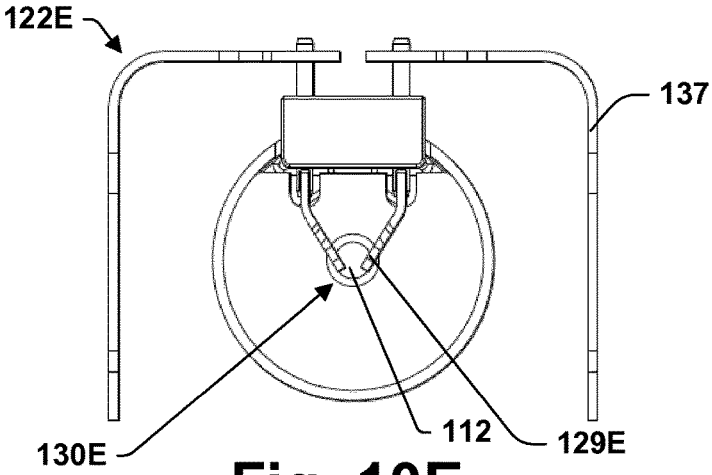
FIG. 10E is a rear view of the electromagnetic latch assembly of FIG. 10A with the contact frame removed.

FIG. 9A-9C illustrates an electromagnetic latch assembly 122D. FIG. 9D illustrates electromagnetic latch assembly 122D installed on the outer arm 103 of a rocker arm assembly 106. Electromagnetic latch assembly 122D is similar to electromagnetic latch assembly 122C. One significant advantage is that electromagnetic latch assembly 122D installs within a chamber 126 formed in rocker arm 103 and keeps both switch 130D and leads 128D for switch 130D within chamber 126. This structure may increase the reliability of switch 130D.

FIG. 10A-10E illustrates an electromagnetic latch assembly 122E that has many features in common with electromagnetic latch assembly 122C, but has a switch 130E to one side of electromagnet 119, which is opposite a side from which latch pin 118 extends. Switch 130E may be closed by a contact plate or other structure mounted on latch pin core 112 or by conduction through latch pin core 112 itself. The components of switch 130E may be protected from the environment around rocker arm assembly 106 by contact frame support 132E.

Figure 11A:
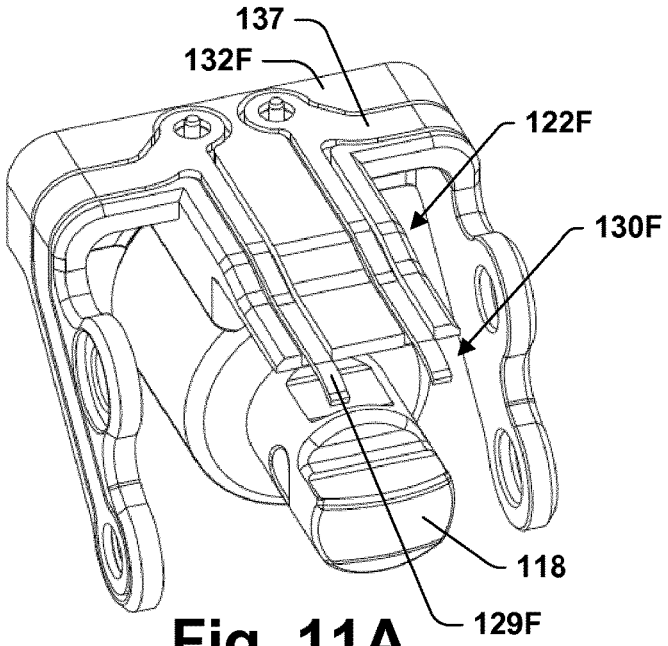
FIG. 11A is a perspective view of an electromagnetic latch assembly according to some aspects of the present teachings.
Figure 11B:
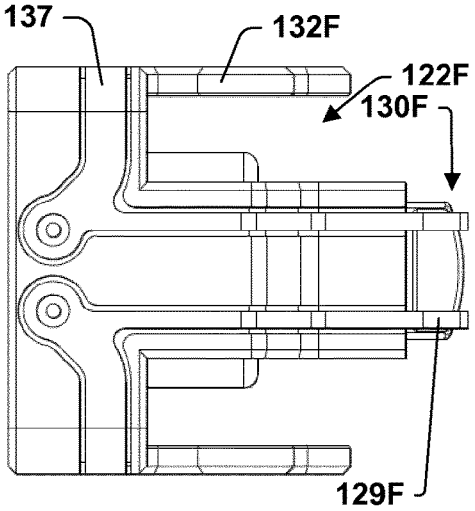
FIG. 11B is a top view of the electromagnetic latch assembly of FIG. 11A.
Figure 11C:
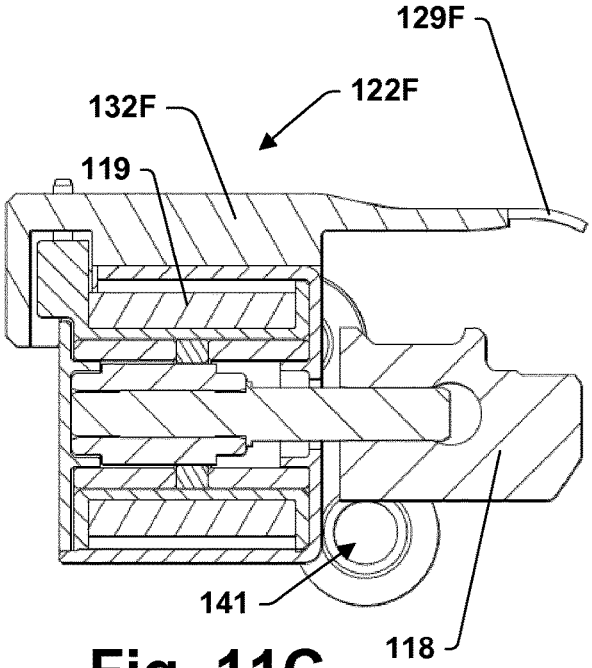
FIG. 11C is a cut-away side view of the electromagnetic latch assembly of FIG. 11A.
Figure 11D:
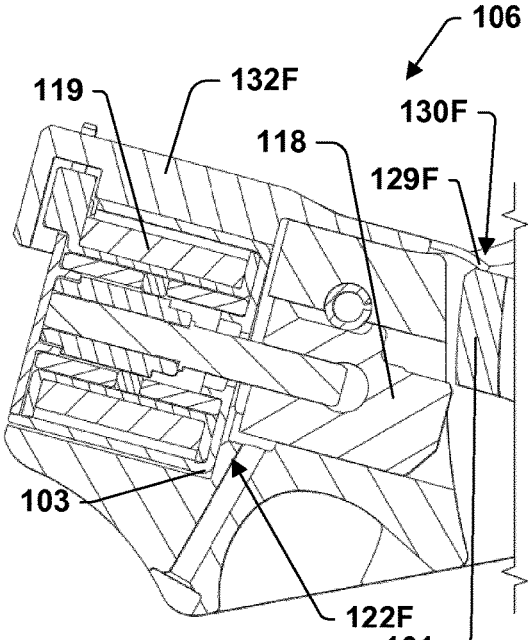
FIG. 11D is a cut-away side view of a rocker arm assembly according to the present teachings that includes the electromagnetic latch assembly of FIG. 11A.

FIG. 11A-11C illustrates an electromagnetic latch assembly 122F. FIG. 11D illustrates electromagnetic latch assembly 122F installed on the outer arm 103 of a rocker arm assembly 106. Electromagnetic latch assembly 122F is similar to electromagnetic latch assembly 122C, but has a switch 130F that includes two contacts 129F positioned to be closed by contact with and conduction through inner arm 101 as shown in FIG. 11D. Switches 130A, 130C, 130D, and 130E all toggle between open and closed as latch pin assembly 115 translates between positions corresponding to latched and unlatched configurations. Switch 130F is always closed when latch pin assembly 115 is in the latching position. When latch pin assembly 115 moves to the non-latching position, switch 130F initially remains closed but opens whenever inner arm 101 is being lifted (pushed downward) by cam 109.

In each of the foregoing examples, the electromagnetic latch assembly 122 is operable to actuate latch pin 118 while switch 130 is closed. Because switch circuit 134 is connected in parallel with coil circuit 133, some power may be lost through switch circuit 134. This power lost may be limited by providing switch circuit 134 with sufficiently high resistance. A resistance source 135 may be introduced into switch circuit 134. The resistance may be provided, for example, by a coating on switch contacts 129. Preferably, the resistance in switch circuit 134 is made at least as great as the resistance in coil circuit 133. More preferably, the switch circuit resistance is at least five times the coil circuit resistance. Most preferably, the switch circuit resistance is at least ten times the coil circuit resistance.

A power circuit for electromagnetic latch assembly 122 will include both switch circuit 134 and coil circuit 133. The power circuit may be driven and the circuit response measured to determine whether switch 130 is open or closed. In its simplest form, a voltage is applied and a resulting current measured and the result analyzed to determine whether switch circuit 134 is contributing to the conductance. Results before and after operations to open and close latch pin 118 may be compared. Moderating the resistance in circuit 134 can facilitate keeping the signal to noise ratio within an acceptable range. To this end, the resistance in switch circuit 134 is preferably at most 1000 times as great as the resistance in coil circuit 133. More preferably, the resistance is at most 100 times as great as the resistance in coil circuit 133. Most preferably, the resistance is at most 20 times as great as the resistance in coil circuit 133.

The power circuit for electromagnetic latch assembly 122 may be pulsed to query the status of switch 130. The pulse may be made insufficient in duration or magnitude to actuate latch pin 118. Alternatively, the pulse may be made of the wrong polarity to actuate latch pin 118 from its current position. Also, while electromagnet 119 may be driven with a DC current to actuate latch pin 118, an AC current may be used to query the switch position.

The switch circuit 134 has been shown as an elementary circuit comprising one or more resistors in series. Optionally, additional elements may be added to switch circuit 134 to facilitate determination of whether switch 130 is open or closed. Those additional elements could include capacitors, transistors, inductors, or combinations thereof.

The components and features of the present disclosure have been shown and/or described in terms of certain embodiments and examples. While a particular component or feature, or a broad or narrow formulation of that component or feature, may have been described in relation to only one embodiment or one example, all components and features in either their broad or narrow formulations may be combined with other components or features to the extent such combinations would be recognized as logical by one of ordinary skill in the art.

The invention claimed is:

1. A rocker arm assembly, comprising:

an electromagnetic latch assembly comprising a latch pin and an actuator, the actuator comprising an electromagnet;

a first rocker arm and a second rocker arm that are selectively engaged by the latch pin;

a switch circuit comprising a switch; and a coil circuit connected in parallel with the switch circuit to power the electromagnet;

wherein:

the actuator is operative to actuate the latch pin between a first position and a second position;

the rocker arm assembly has a configuration that depends on one or more latch pin positions and relative positions of the first rocker arm and the second rocker arm;

the switch is open or closed depending on the configuration of the rocker arm assembly; and the switch is opened and closed by translation of the latch pin.

2. The rocker arm assembly of claim 1, wherein the actuator is operative to actuate the latch pin between the first position and the second position whether the switch is open or closed.

3. The rocker arm assembly of claim 1, wherein:

the switch circuit has a higher resistance than the coil circuit; and most of the switch circuit resistance is provide by one or more coatings on contact surfaces of the switch.

4. The rocker arm assembly of claim 1, wherein:

the electromagnetic latch assembly comprises terminals at coil tie-offs for the electromagnet; and the terminals are terminals for the switch circuit.

5. The rocker arm assembly of claim 1, wherein the electromagnetic latch assembly comprises one or more permanent magnets that make the latch pin's position stable independently from the electromagnet both when the latch pin is in the first position and when the latch pin is in the second position.

6. The rocker arm assembly of claim 1, wherein one terminal of the coil circuit is grounded through a structure of the rocker arm assembly.

7. The rocker arm assembly of claim 1, wherein the switch is closed by conduction through a structural component of the rocker arm assembly.

8. The rocker arm assembly of claim 7, wherein the switch is opened and closed by translation of the latch pin.

9. The rocker arm assembly of claim 7, wherein the switch is opened and closed by relative movement between the first rocker arm and the second rocker arm.

10. The rocker arm assembly of claim 1, wherein:

the actuator comprises a core support configured to translate along an axis through the electromagnet;

the core support has first and second ends, opposite one-another along the axis;

the latch pin is mounted on the first end of the core support; and the switch is at the second end of the core support.

11. The rocker arm assembly of claim 10, wherein the switch is opened and closed by translation of the latch pin.

12. The rocker arm assembly of claim 1, further comprising:

a frame providing electrical contacts for transferring power to the rocker arm assembly;

wherein wiring for the switch circuit is mounted to the frame.

13. The rocker arm assembly of claim 12, wherein the switch is opened and closed by translation of the latch pin.

14. The rocker arm assembly of claim 12, wherein the switch is opened and closed by relative movement between the first rocker arm and the second rocker arm.

15. The rocker arm assembly of claim 1, wherein wiring for the switch circuit is inside either the first rocker arm or the second rocker arm.

16. A method of operating the rocker arm assembly of claim 1, comprising:

pulsing a circuit that includes the coil circuit; and analyzing a response to the pulse to determine if a portion of the pulse current passed through the switch circuit.

17. The method of claim 16, wherein the pulse is insufficient to actuate the latch pin.

18. A rocker arm assembly, comprising:

an electromagnetic latch assembly comprising a latch pin and an actuator, the actuator comprising an electromagnet;

a first rocker arm and a second rocker arm that are selectively engaged by the latch pin;

a switch circuit comprising a switch; and a coil circuit connected in parallel with the switch circuit to power the electromagnet;

wherein:

the actuator is operative to actuate the latch pin between a first position and a second position;

the rocker arm assembly has a configuration that depends on one or more latch pin positions and relative positions of the first rocker arm and the second rocker arm; and the switch is open or closed depending on the configuration of the rocker arm assembly, wherein the switch is opened and closed by relative movement between the first rocker arm and the second rocker arm.

19. A rocker arm assembly, comprising:

an electromagnetic latch assembly comprising a latch pin and an actuator, the actuator comprising an electromagnet;

a first rocker arm and a second rocker arm that are selectively engaged by the latch pin;

a switch circuit comprising a switch; and a coil circuit connected in parallel with the switch circuit to power the electromagnet;

wherein:

the actuator is operative to actuate the latch pin between a first position and a second position; and the switch is opened or closed by relative motion between the first rocker arm and the second rocker arm;

when the first rocker arm and the second rocker arm are engaged by the latch pin, the first rocker arm and the second rocker arm are prevented from undergoing the relative motion that opens or closes the switch.

20. The rocker arm assembly of claim 19, wherein the switch is closed by conduction through a structural component of the rocker arm assembly.

* * * * *